US006827030B2

(12) United States Patent
Hicks

(10) Patent No.: US 6,827,030 B2
(45) Date of Patent: Dec. 7, 2004

(54) MAGNETICALLY DRIVEN TUFTING MACHINES AND METHODS

(75) Inventor: Bobby Hicks, Tunnell Hill, GA (US)

(73) Assignee: Hicks Tufting Machine Service, Inc., Tunnell Hill, GA (US)

( * ) Notice: Subject to any disclaimer, the term of this patent is extended or adjusted under 35 U.S.C. 154(b) by 113 days.

(21) Appl. No.: 10/163,722

(22) Filed: Jun. 4, 2002

(65) Prior Publication Data

US 2003/0005869 A1 Jan. 9, 2003

Related U.S. Application Data

(60) Provisional application No. 60/295,745, filed on Jun. 4, 2001.

(51) Int. Cl.[7] ..... D05B 19/12; D05C 15/20

(52) U.S. Cl. ..... 112/80.23; 112/80.41; 112/80.56

(58) Field of Search ..... 112/80.23, 80.01, 112/80.41, 80.4, 80.45, 80.55, 80.56, 80.32, 80.24, 470.01

(56) References Cited

U.S. PATENT DOCUMENTS

| | | | |
|---|---|---|---|
| 4,173,192 A | 11/1979 | Schmidt et al. | |
| 4,759,199 A | 7/1988 | Prichard | |
| 5,005,498 A | 4/1991 | Taylor et al. | |
| 5,526,760 A | 6/1996 | Ok | |
| 5,645,001 A | 7/1997 | Green et al. | |
| 5,794,551 A | 8/1998 | Morrison et al. | |
| 5,979,344 A | 11/1999 | Christman, Jr. | |
| 6,283,052 B1 | 9/2001 | Pratt | |
| 6,293,210 B1 * | 9/2001 | Freeman et al. | 112/80.01 |

OTHER PUBLICATIONS

International Search Report in PCT/US02/17300, applicant Hicks Tufting Machine Service, Inc.
Brochure from Sew Eurodrive, MoviMot, the Smart Gearmotor, printed 5/98.
Brochure from Sew Eurodrive, MoviDrive, Universal Motor Controller, printed 5/99.
Webpage from California Linear Devices, Inc., http://www.calinear, com/products/index.html, dated Apr. 12, 2000.
Designfax, Tubular Linear Motor, 2 page article "as seen in Nov. 2000 Issue of Designfax Magazine," page numbers not given.

* cited by examiner

*Primary Examiner*—Peter Nerbun
(74) *Attorney, Agent, or Firm*—Geoffrey K. Gavin; Kilpatrick Stockton LLP

(57) ABSTRACT

A tufting machine has drives for shifting needle bars, pushing needle bars, rocking loopers, knives, and hooks. The drives require less maintenance, result in less wear, are highly accurate, can operate at high speeds and at high loads, and are easily programmable. The drives avoid the need for oil bathes for the moving parts and therefore reduce spillage onto tufted products. The drives are quiet and thus are preferably over many hydraulic drives. The drives are preferably linear drives and, more preferably, are electromagnetic drives.

10 Claims, 10 Drawing Sheets

MAGNETICALLY DRIVEN TUFTING MACHINES AND METHODS

RELATED APPLICATIONS

This application claims priority to, and incorporates by reference, co-pending provisional patent application Ser. No. 60/295,745, filed Jun. 4, 2001 entitled "Magnetically Driven Tufting Machines and Methods."

FIELD OF THE INVENTION

The invention relates generally to tufting machines and methods of tufting and, more particularly, to tufting machines and tufting involving magnetically driven elements.

BACKGROUND

A tufting machine is comprised of a number of moving parts. For instance, a tufting machine has a needle bar which goes up and down moving needles into and out of a backing material that moves along a bedrail. The bedrail itself typically moves up and down to adjust the height of the pile. In addition to moving the needles up and down, the needle bar itself can move back and forth in order to create a pattern in the produced carpet. The tufting machine also has loopers that rock back and forth catching the loops of yarn as it passes through the backing material or a combination of hooks and knives that pivot about for grabbing and then cutting the yarn to create a cut pile carpet. The movement of all of these parts and elements must be synchronized in order to produce a carpet having a desired pattern of either loop pile or cut pile.

Conventionally, many of these parts of a tufting machine were mechanically coupled through a set of gears and belts. These types of tufting machines had a main timing shaft that was mechanically coupled to a set of secondary shafts for controlling the loopers, knives, hooks, and needles. This type of tufting machine, however, was troublesome in that it was difficult to change the type of carpet produced, such as by changing the pattern.

As an example of the difficulty in making an adjustment to a tufting machine, an explanation will now be given on how adjustments are made in a needle bar drive. A common needle bar drive includes a cam having a contour that dictates the shifting of the needle bar. In operation, the cam is rotated and the needle bar is coupled to the outer edge of the cam. A lobe or cut-a-way is produced along the surface of the cam in order to shift the needle bar in one direction and then the radius of the cam is increased in order to shift the needle bar back in the opposite direction. Thus, the needle bar is shifted according to a sequence determined by the contour of this cam.

A difficulty with using such a cam is that in order to change the pattern, a new cam having a different contour must be placed on the tufting machine. These cams are heavy and thus are not easily replaced. For instance, some cams weigh close to 75 pounds. Additionally, the tufting machine must be placed out of commission for a period of time, such as twenty to forty-five minutes, to replace the cams. If a new cam must be produced, machining the new cam may take an hour or more before it is even ready to be placed on the tufting machine. Furthermore, these cams eventually wear out and need to be replaced. In addition to the cams, the tufting machines also have sprockets. The sprockets control the number of times the needles go up and down relative to one rotation of the cam. To change the number of times, the sprocket would have to be replaced and the new sprocket would either speed that up or slow it down depending on its size.

Another approach to shifting the needle bar is to use a hydraulic drive. For example, U.S. Pat. No. 4,173,192 to Schmidt et al. which is incorporated herein by reference discloses a hydraulic actuator for transversely shifting the needle bar. Tuftco of Chattanooga, Tenn., manufacturers a hydraulic tufting machine called the HydroShift. This type of tufting machine requires a hydraulic actuator, an oil bin, filters, hydraulic lines, transducers, and a pump in order to hydraulically drive the needle bar. This type of tufting machine requires a great deal of maintenance and supervision due to the use of hydraulic fluids and lines. Furthermore, the pump produces a considerable amount of noise during operation, which can be quite bothersome.

Other examples of tufting machines are shown and described in U.S. Pat. No. 4,759,199 to Prichard, U.S. Pat. No. 5,005,498 to Taylor et al., U.S. Pat. No. 5,526,760 to Ok, U.S. Pat. No. 5,645,001 to Green et al., U.S. Pat. No. 5,794,551 to Morrison et al., and U.S. Pat. No. 5,979,344 to Christman, Jr., which are all hereby incorporated by reference. Some of these patents describe the use of servo motors and others describe screw actuators for use in driving the elements.

A common problem with many of these tufting machines is that they require a considerable amount of maintenance and supervision. For instance, the screw drives and other mechanically-coupled parts wear down over time, require maintenance, and are difficult to change over to a new setting. Another common problem for many of these tufting machines, especially with the needle shifting, is that the tufting machines require oil for lubrication for these moving elements and also for cooling. For instance, servo-driven tufting machines are oil cooled while many of the needle shifting bars have oil for lubrication. Unfortunately, this oil occasionally leaks from overhead, such as from a bin for lubricating the needle shifting mechanism, and comes in contact with the backing and the carpet being produced.

A need therefore exists for tufting machines that require less maintenance, result in less wear to the components, offer a quicker change over, and result in less spillage of oil than existing tufting machines.

SUMMARY

The invention addresses the problems above by providing systems, tufting machines, and methods for tufting which require less maintenance, result in less wear in moving components, and also allow for a quicker change over when adjusting settings on the tufting machine. The moving components within these tufting machines do not require any bed or bath of oil to lubricate or cool the components. Furthermore, the movements can be precisely controlled to within a high degree of accuracy, at high speeds, and at controlled acceleration and deceleration. The movements may furthermore be programmed for allowing an easy and quick changeover to new settings.

In the preferred embodiments, the tufting machines use linear servo motors, and more preferably, magnetic drives. For instance, a shifting needle bar may be comprised of at least one rod attached to the linear motor for controlling the shifting of the needle bars. A position sensor associated with the linear drive provides position information to a processor which also generates control signals for precisely controlling the shifting of the needle bar. With such a linear drive, the needle bar can be shifted at speeds more than 800 to 1000 times a minute. This type of drive eliminates the need for any conversion between rotary to linear motion and also does not require hydraulic drives. The tufting machine with this type of shifting mechanism for the needle bar can therefore eliminate an oil bin placed above the tufting machine intended to lubricate the shifting needle bar. Consequently, the tufting machines according to the invention result in less spillage of oil onto the carpet and backing material. The tufting machines also offer a more quiet operation, which is a substantial improvement over many tufting machines, especially the hydraulically driven tufting machines.

In addition to the needle shifting mechanism, tufting machines according to the invention preferably include linear drives for moving the needles up and down, for lowering or raising the bed rail, for pivoting the hooks and knifes, and for rocking the loopers. A preferred tufting machine according to the invention need not have any main drive shaft as well as no associated cams, belts, and gears that are tied to the main shaft. The tufting machines according to the invention can be highly programmable with the processor controlling the various linear drives to synchronize the movements of the components. For instance, an encoder can be used to generate the timing signals for the various linear drives, with this encoder being associated with a main shaft or with the backing feed, such as on a roller.

The tufting machines according to the invention encompasses both entirely new tufting machines constructed with the drives according to the invention as well as tufting machines retrofitted to have one or more of the linear drives.

Other advantages and features of the invention will be apparent from the description below.

BRIEF DESCRIPTION OF DRAWINGS

The accompanying drawings, which are incorporated in and form a part of the specification, illustrate preferred embodiments of the present invention and, together with the description, disclose the principles of the invention. In the drawings.

DETAILED DESCRIPTION

Reference will now be made in detail to preferred embodiments of the invention, non-limiting examples of which are illustrated in the accompanying drawings.

Figure 1:
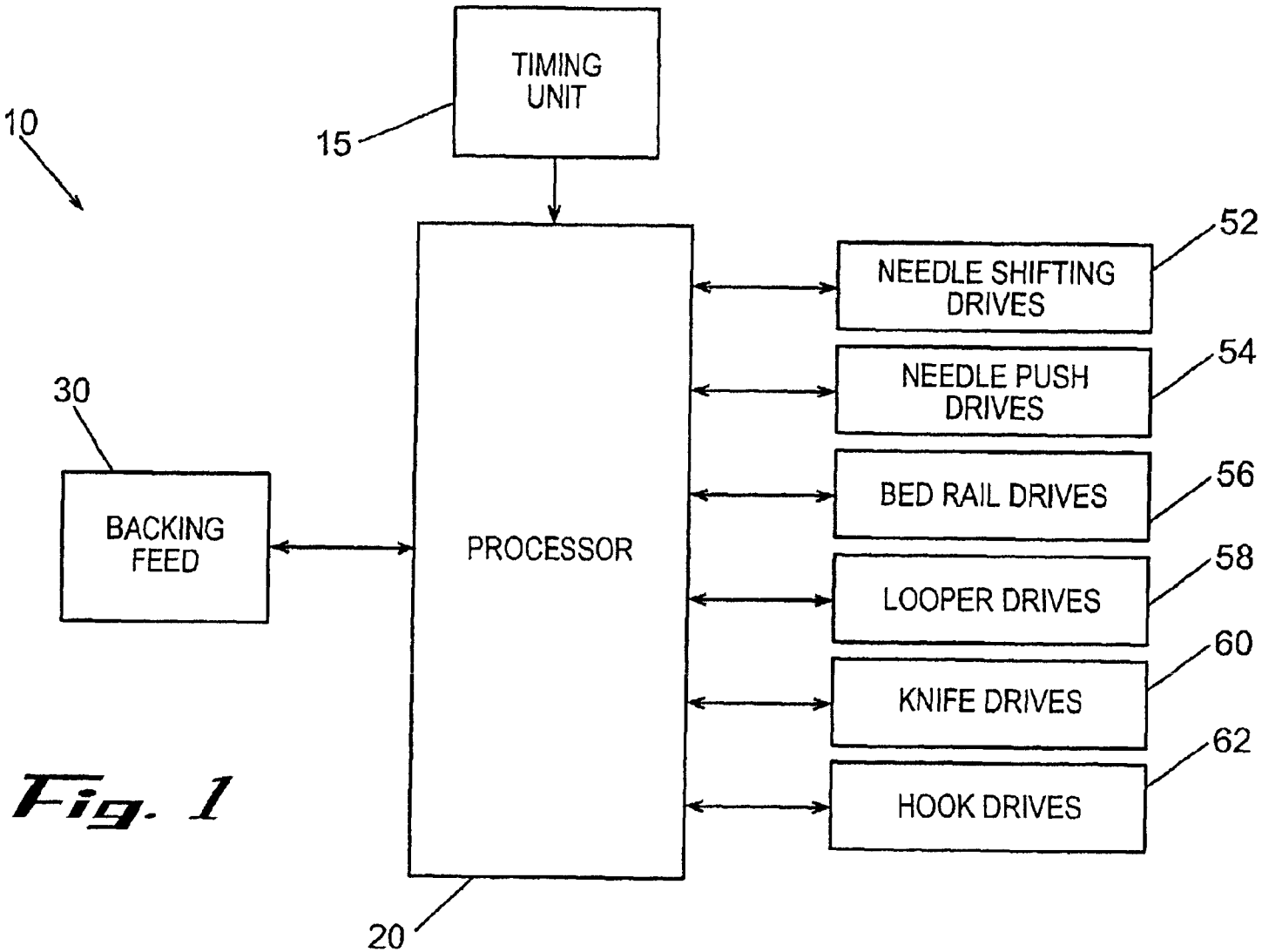
FIG. 1 is a partial block diagram of a tufting machine according to a preferred embodiment of the invention, including a processor and various drives and feeds.

FIG. 1 illustrates a partial diagram of a tufting machine 10. The tufting machine 10 includes a processor 20 for controlling a number of drives 52, 54, 56, 58, 60, and 62. The tufting machine 10 also includes a timing unit 15 and a backing feed 30. In this example, the tufting machine 10 has electromagnetic or linear drives for each of needle shifting drives 52, needle pushing drives 54, bed rail drives 56, looper drives 58, knife drives 60, and hook drives 62. The timing unit 15 may comprise any suitable timing device for allowing the processor 20 to suitably control the drives 52, 54, 56, 58, 60, and 62 to produce a desired tufted product. For example, the timing unit 15 may comprise an encoder, a resolver, or a stepping motor which generates suitable timing signals to synchronize these various drives within the tufting machine 10. The backing feed 30 may comprise any suitable drive mechanism for feeding the backing material through the tufting machine, such as drives including servo motors.

The tufting machine 10 may be used to produce any type of tufted material or product. For example, the tufting machine 10 may be used to produce loop pile carpet, cut pile carpet, rugs, as well as other products. As mentioned above, the tufting machine 10 preferably uses linear drives for each of the drives 52, 54, 56, 58, 60, and 62, and, more preferably, uses electromagnetic drives. One suitable provider of linear drives is California Linear Devices, Inc. of Carlsbad, Calif. The tufting machine 10, however, may include linear drives for one or more, or even any combination of, the drives 52, 54, 56, 58, 60, and 62. Consequently, tufting machines according to the invention have at least one linear drive, preferably an electromagnetic drive, and any combination of servo drives, hydraulic drives, cam drives, belt drives, or other types of drives.

Figure 2:
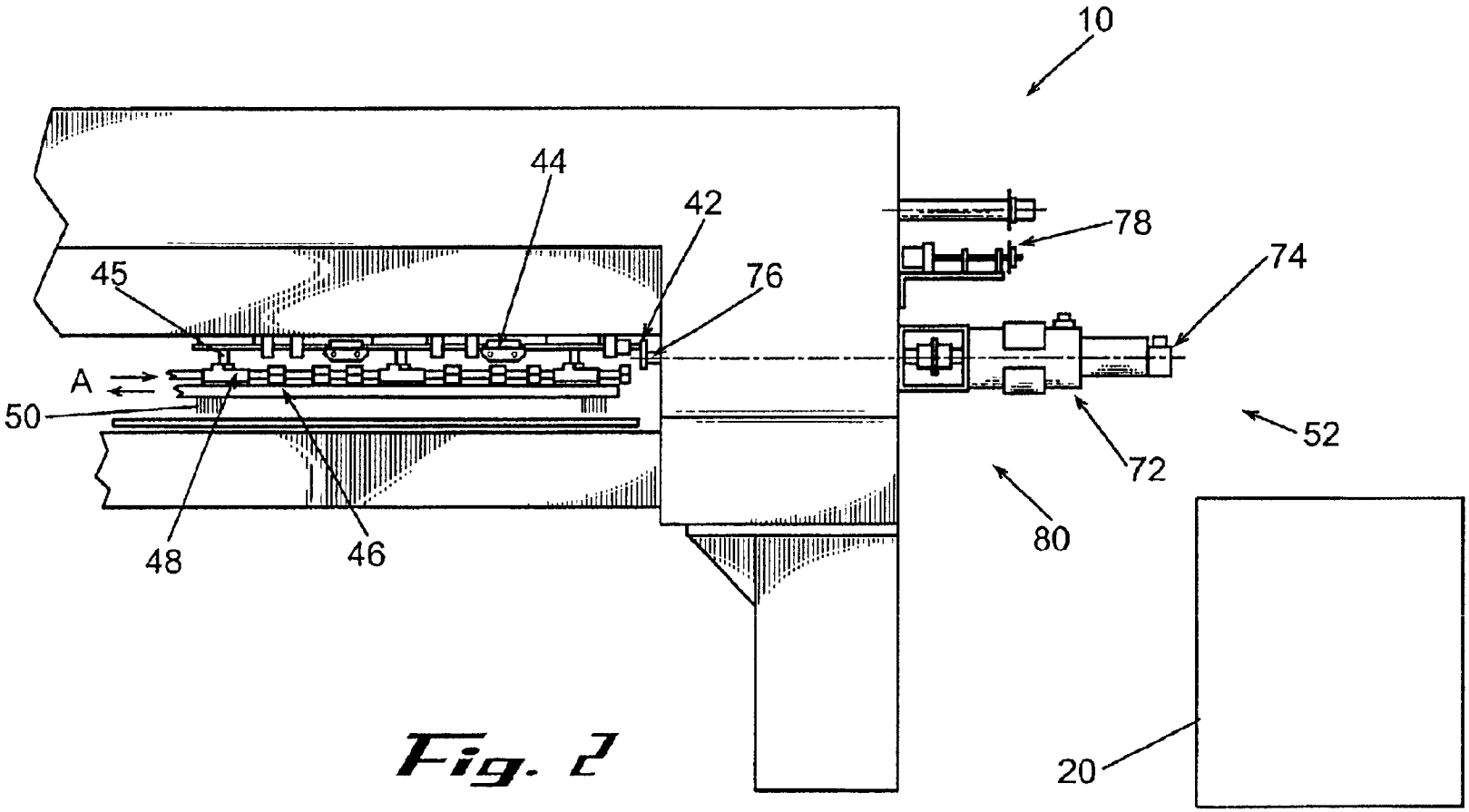
FIG. 2 is a partial side view of a tufting machine having a linear drive for a needle bar according to one embodiment of the invention.

A more detailed description of the needle shifting drive 52 will now be described with reference to FIG. 2. As shown in this figure, the tufting machine 10 includes an electromagnetic tubular linear motor 72 having an associated position sensor 74 for informing the processor 20 of the position of a needle bar 76. The position sensor 74 can be separate from a stator of the motor 72 or, more preferably, can be integrated as a single unit with the stator. The linear motor 72 may include fans for cooling associated electronics and electro-magnets within the drive 52. The tufting machine 10 also includes an encoder 78, which, in this example, is coupled to a main shaft. The encoder 78 need not be coupled to a main shaft and, in fact, the tufting machine 10 need not be constructed with any main shaft. Instead, the encoder 78 may be coupled to part of the backing feed mechanism, such as on a roller. The encoder 78 serves as the timing unit 15 and provides timing signals to the processor 20 which enables the processor 20 to control the various drives 52, 54, 56, 58, 60, and 62.

The electromagnetic tubular linear motor 72 preferably has a locator assembly 80 for monitoring a position of the needle bar 76. The linear motor 72 moves, or shifts, the needle bar 76 in a lateral movement shown by arrows A. This shifting movement of the needle bar 76 enables the tufting machine to alter the positions at which yarns are being inserted into a backing material. By shifting the needle bar 76 and by using different colored yarns, the tufting machine 10 is therefore able to form patterns in the tufted products. To control the pattern that is formed, the tufting machine 10 must have some knowledge of the location of the needle bar 76.

The locator assembly 80 assists in providing the processor 20 with some knowledge of the position of the needle bar 76. In the embodiment shown in FIG. 1, the locator assembly 80 has an adjustment point for allowing the processor 20 to position the needle bar 76 at a home position upon power-up of the tufting machine 10. The position sensor 74 provides position data to the processor 20 which enables the processor 20 to determine an amount of distance the needle bar 76 has deviated from the home position, and thus determine the position of the needle bar 76. The locator assembly 80 not only provides a center or home position for the needle bar 76 but preferably also provides points defining the permissible range of movement for the needle bar 76. From this information, the processor 20 can restrict movement of the needle bar 76 to within a permissible range.

Figure 3:
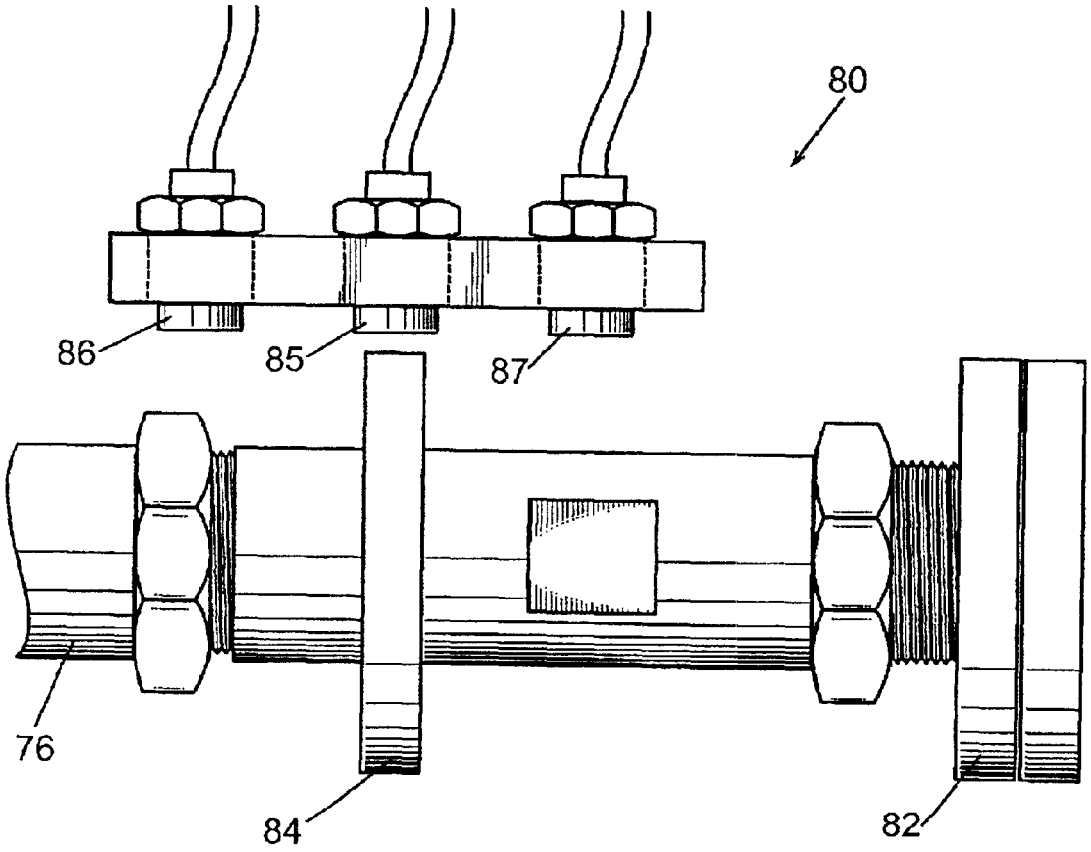
FIG. 3 is a schematic diagram of a locator assembly according to a preferred embodiment of the invention.

The locator assembly 80 is shown in more detail in FIG. 3. An end of the needle bar 76 is connected to a shaft 82 forming part of the electromagnetic tubular linear motor 72, whereby the motor 72 and needle bar 76 move as an integral shaft. The locator assembly 80 includes a marker 84, which in the preferred embodiment is a protrusion 84 along part of the shaft formed by the needle bar 76 and the shaft 82 of the motor 72. The locator assembly 80 includes a center sensor 85 for detecting the presence of the marker 84 and for sending an appropriate signal to the processor 20. When the marker 84 is positioned at the center sensor 85, the processor 20 determines that the needle bar 76 is at the home position. The locator assembly 80 also includes two end of range sensors 86 and 87. As with the center sensor 85, the end of range sensors 86 and 87 send signals to the processor 20 upon detecting the presence of the marker 84. The processor 20 can therefore control the linear motor 72 to ensure that the needle bar 76 remains within the permissible range of movement defined by the end of range sensors 86 and 87.

Thus, when the linear motor 72 moves the needle bar 76 to a position where the marker 84 is in close proximity to the sensor 85, the tufting machine 10 determines that the needle bar 76 is in the home position. When the linear motor 72 moves the needle bar 76 to a position where the marker 84 proceeds down to its fully inserted position, the end of range sensor 86 detects the marker 84 and informs the processor 20 of such an event. Similarly, when the linear motor 72 moves the needle bar 76 so that the marker 84 is at the sensor 87, the processor 20 determines that the needle bar 76 is at its fully retracted position.

The needle bar 76 is not restricted to the manner in which it is connected to needles 50 and thus may be connected in ways known to those skilled in the art. For instance, with reference to FIG. 1, the needle bar 76 is connected to drive brackets 42 and to camrol brackets 44. These brackets 42 and 44 permit needles 50 to move in a lateral direction back and forth in the direction of arrows A in order to produce patterns in the tufted product. The needle bar 76 preferably has at least 4 inches of movement along the lateral direction, which corresponds to the distance between end of range sensors 86 and 87, and may have a greater range of movement if desired.

In addition to this lateral movement, the tufting machine 10 includes the needle push drives 54 for moving the needles 50 in up and down directions, or along a vertical axis. The needle bar 76 is attached to support brackets 46 and can move up and down through the use of push rod feet 48. A Hardin drive block has a cam auger for causing the needle bar 76 to go up and down. Needle drive push rods 45 are used in pushing the needles 50 up and down. The needle bar 76 stays in position while it is going down through a backing material so the needles 50 do not crack. When the needles 50 come back up after they clear the backing material, the needle bar 76 can shift to the next gauge or over a greater number of gauges in order to shift to a desired position. As should be apparent from the description above, the needle bar 76 can shift the needles 50 left and right and have the needles 50 go up and down simultaneously.

In one embodiment of the tufting machine 10, the bed rail drives 56, looper drives 58, knife drives 60, and hook drives 62 may be comprised of conventional drives. For example, shafts, such as Thompson shafts or Hardin shafts, have been used to cause balls to move in back and forth directions. A jerker guide feeds yarn down to it, with one tied down to one of the shifting shafts and letting a second needle shaft, if more than one is present, float in it. The backing feet are all stationary and do not move. The yarn passes through the needles 50 and then the hooks pick it up with the backing running under it.

Figure 4A:
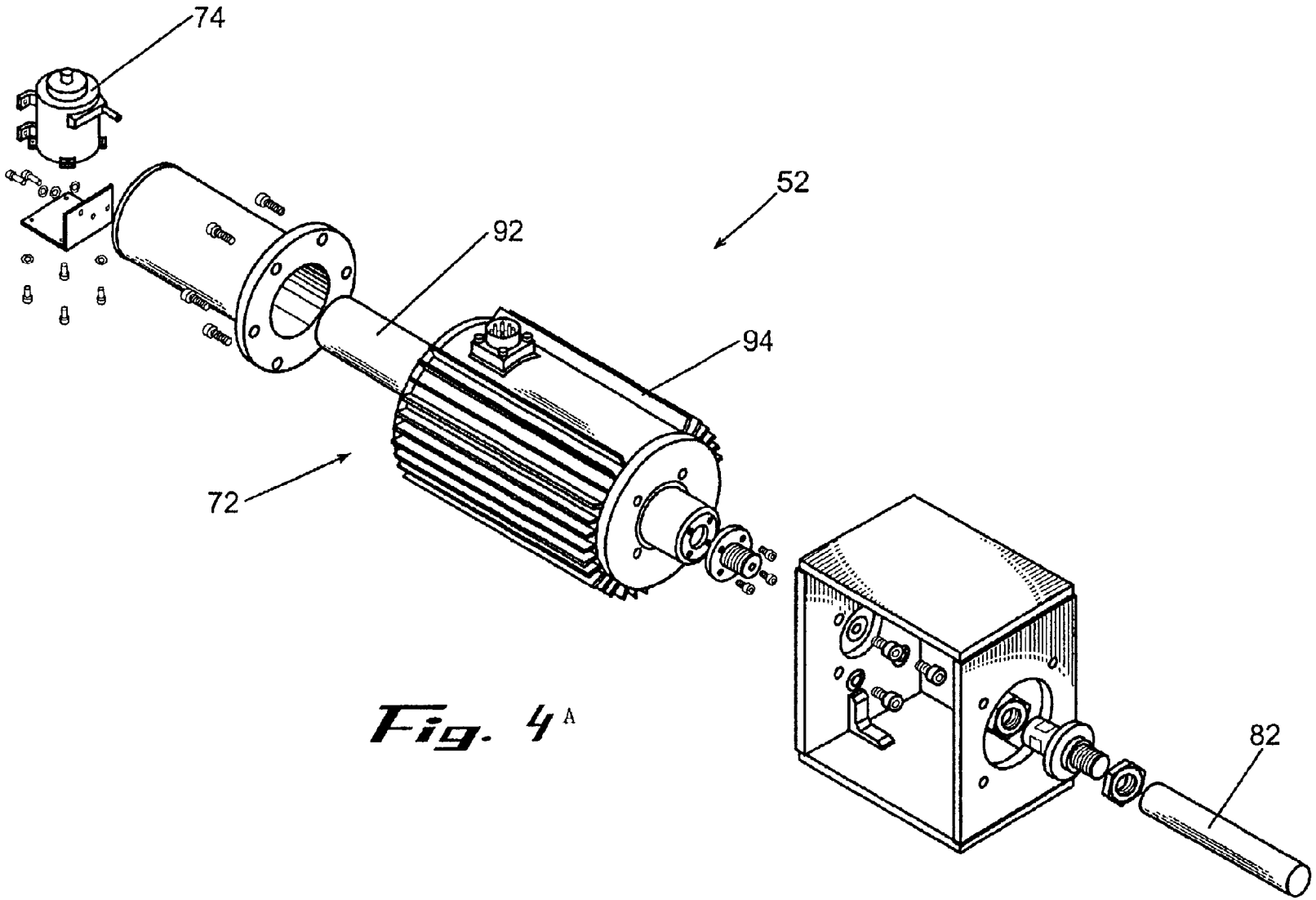
FIGS. 4A and 4B are partial exploded views of a linear motor according to embodiments of the invention.

FIG. 4A is an exploded view of the linear drive 52 used in the tufting machine 10 for shifting the needle bar 76. The linear drive 52 includes the linear motor 72 which includes a stator 94 and a shaft 92. The shaft 92 passes through the stator 94 and is connected to the shaft 82 of the needle bar 76. The linear drive 52 also includes the position sensor 74 which has a probe that extends the length of the motor 72 running through the center of the stator 94.

Figure 4B:
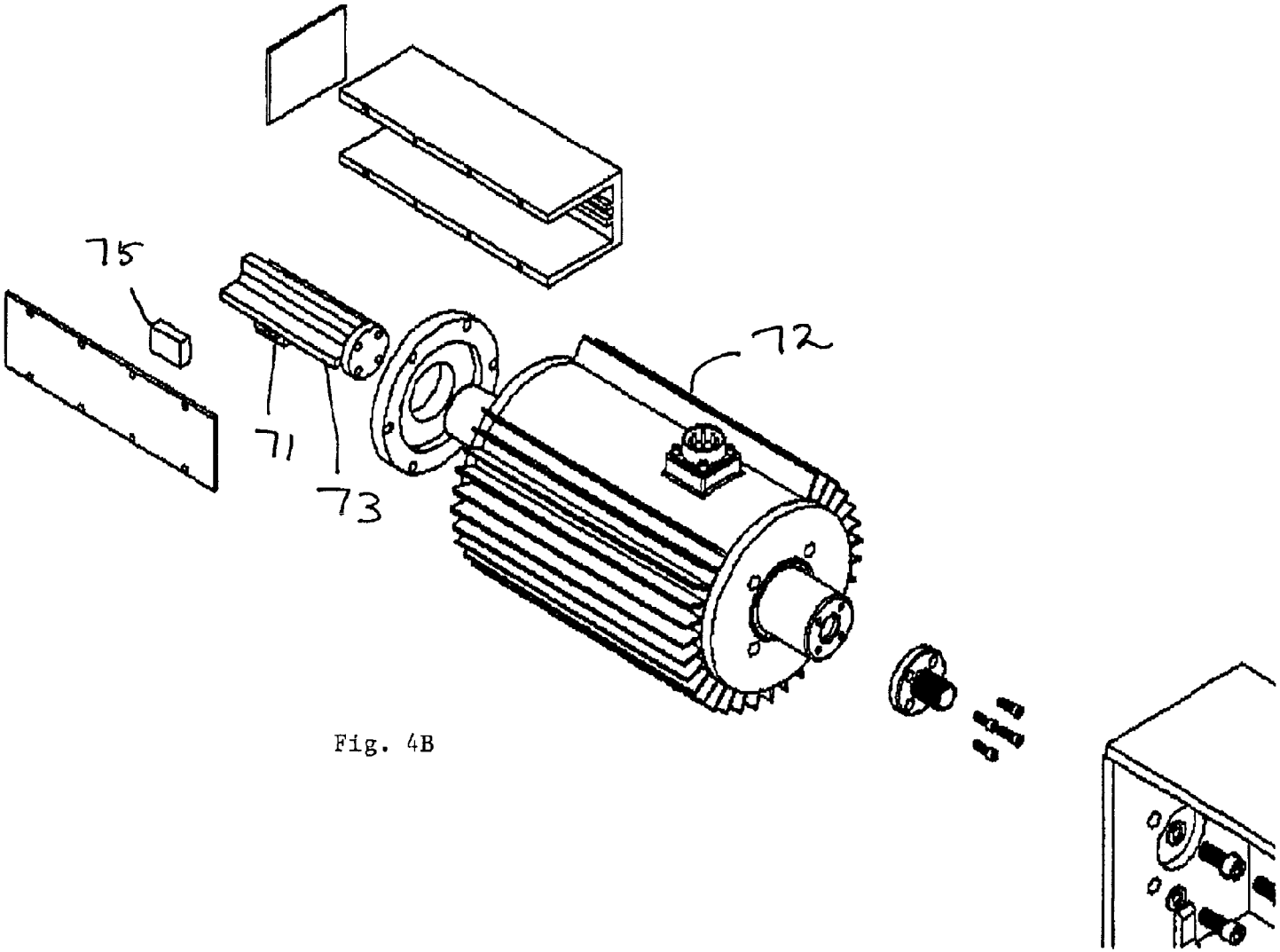

The processor 20 may detect and monitor the position of the linear motor 72 in other ways. Preferably, rather than using the sensors 85, 86, and 87 and the marker 84, the linear motor 72 has a linear encoder attached to an end of the shaft 92 as shown in FIG. 4B. A Hall-effect switch 71 detects a home position of the needle bar 76. A read head 75 in association with a linear scale 73 provides position signals to the processor 20. The linear encoder may comprise a scale 73, switch 71, and read head 75 from Renishaw PLC of Gloucestershire, United Kingdom.

Figure 5:
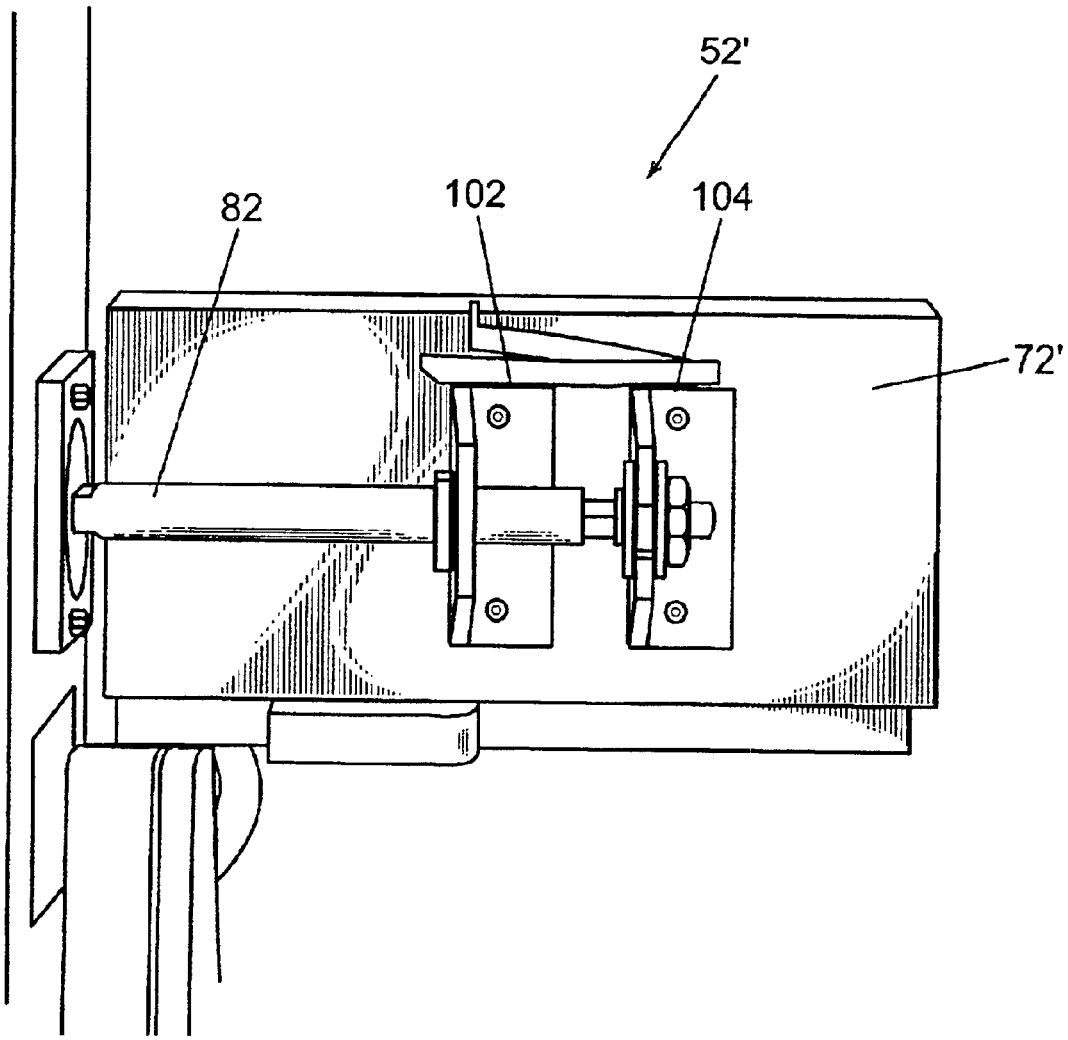
FIG. 5 is a schematic diagram of a linear drive for a needle bar according to another embodiment of the invention.

FIG. 5 illustrates a linear drive 52' for use with tufting machines according to another embodiment of the invention. The drive 52' shown in FIG. 5 is an electromagnetic drive like drive 52 but differs in that linear motor 72' is a flat motor whereas linear motor 72 is a tubular drive. The linear drive motor 72' has a planar fixed member 102 and a second planar member 104 which is movable and attached to the needle bar shaft 82. The linear drive motor 72' is also available from California Linear Devices, Inc.

Figure 6:
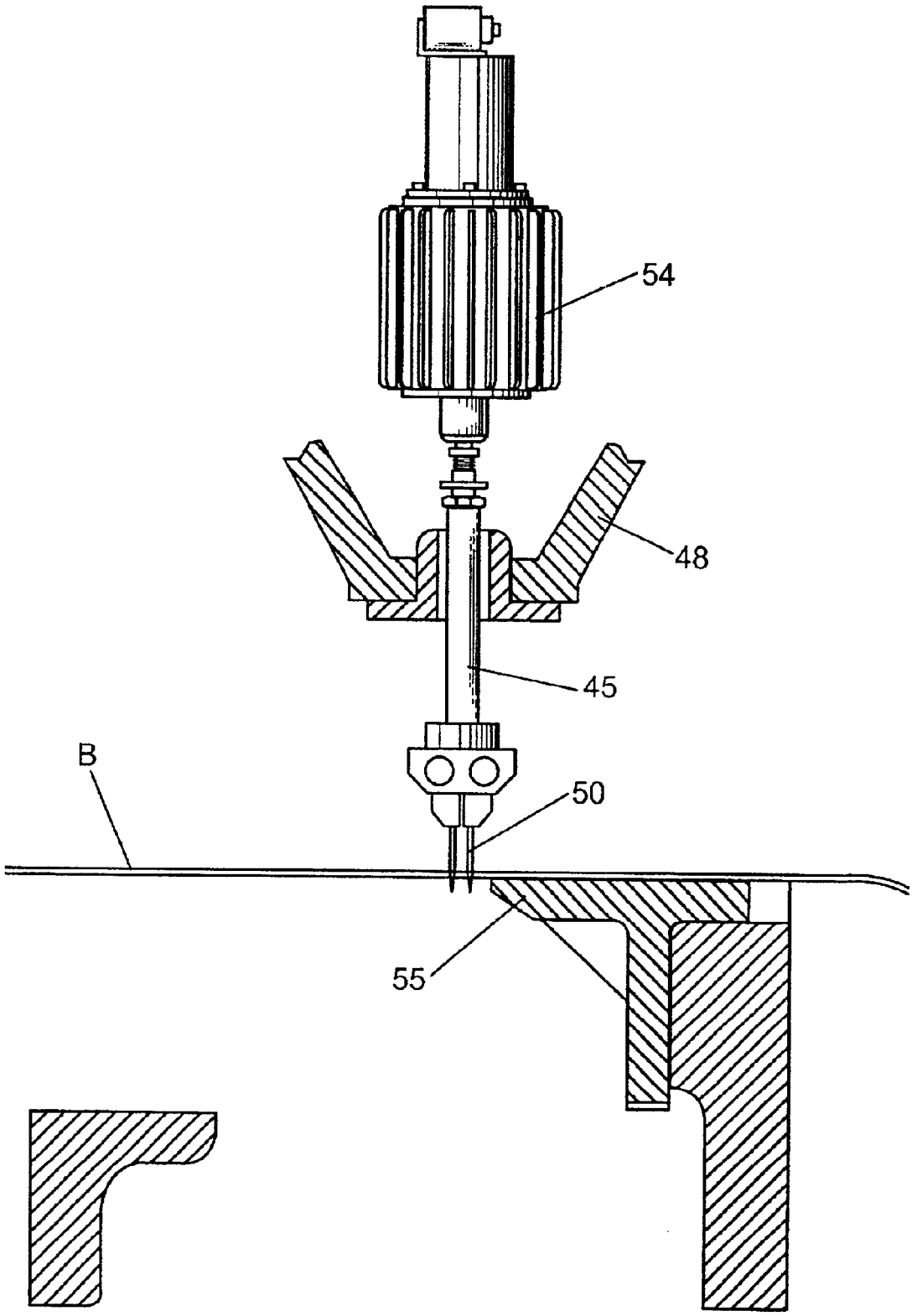
FIG. 6 is an exemplary diagram of a needle push drive having a linear drive according to another embodiment of the invention.

FIG. 6 illustrates an example of the needle push drive 54 having a linear drive according to an embodiment of the invention. The tufting machine 10 may include multiple needle push drives 54 for directly moving the needle drive push rods 45, and hence the needles 50, up and down. As shown in this figure, the needle drive 54 controls the up and down movement of the needles 50 into the backing material B. A bed rail 55 positions the backing material B at a desired distance relative to the needles 50. The needle drive push rod 45 is coupled to the push rod foot 48 in a conventional manner. Alternatively, rather than having the needle push drives 54 be directly coupled to the push rods 45, the needle push drives 54 may be positioned at ends of the tufting machine 10 and the motion of the needle push drivers 54 may be at an angle to the movement of the needles 50 up and down with some suitable coupling between the drives 54 and the needle bars, such as a rocker assembly.

Figure 7:
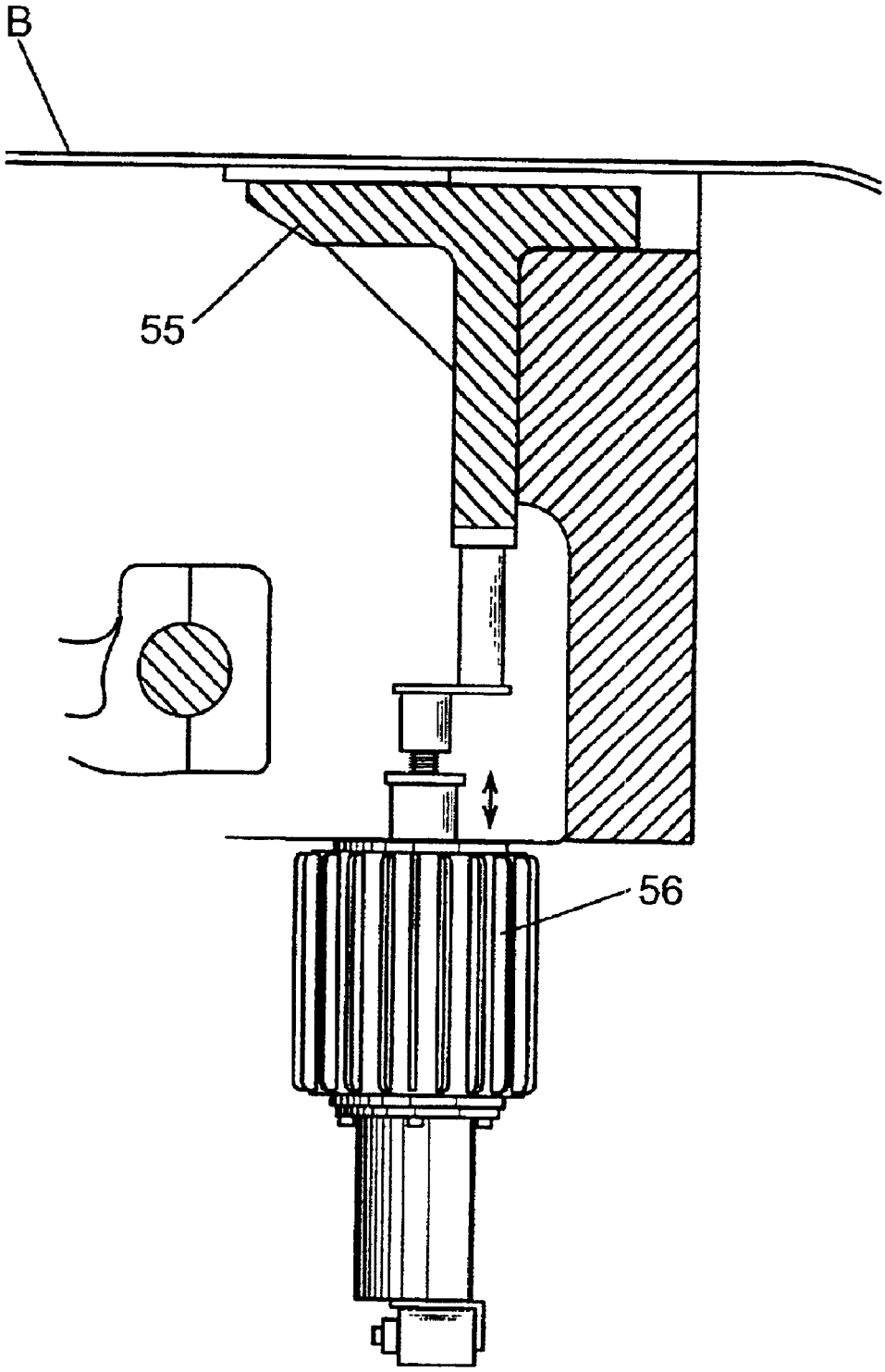
FIG. 7 is an exemplary diagram of a bedrail drive having a linear drive according to another embodiment of the invention.

FIG. 7 illustrates an example of the bed rail drive 56 having a linear drive according to an embodiment of the invention. The bed rail drive 56 is for controlling the height of the bed rail 55 and for placing the backing material B at the desired distance relative to the needles 50. As is known to those skilled in the art, the height of the bed rail 55 controls the size of the loops or the length of the cut pile. Again, the tufting machine 10 may include one or more of these bed rail drives 56 for adjusting the height of the bed rail 55.

Figure 8B:
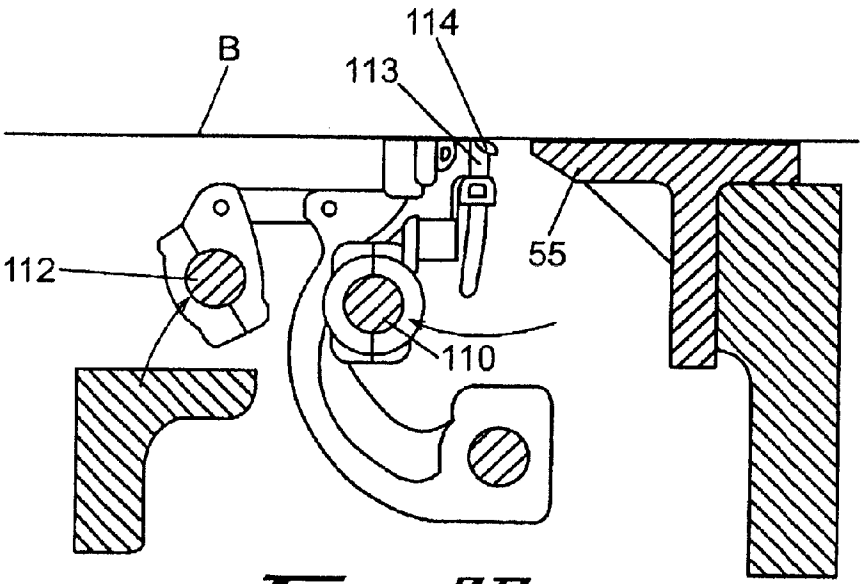
FIGS. 8(A) and 8(B) are exemplary diagrams of hook and knife drives having linear drives according to another embodiment of the invention.
Figure 8A:
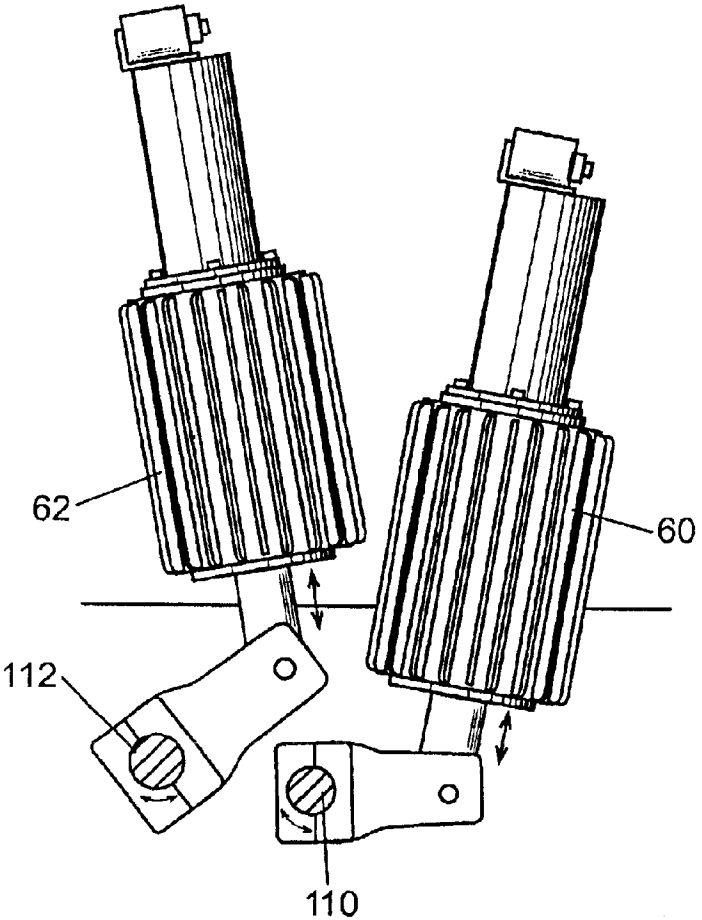

FIGS. 8(A) and 8(B) illustrate examples of knife drives 60 and hook drives 62 having linear drives according to an embodiment of the invention. As is clear from these figures, movement of the knife drive 60 rotates a knife drive shaft 110 and thus the knives 113 associated with the shaft 110. The hook drive 62 also controls the rotation of a hook drive shaft 112 and thus the positioning of the hooks 114during operation of the tufting machine 10.

Figure 9B:
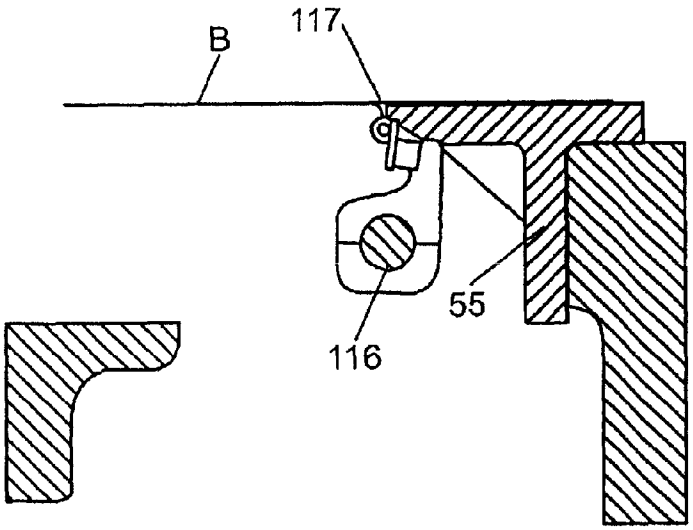
FIGS. 9(A) and 9(B) are exemplary diagrams of looper drives having linear drives according to another embodiment of the invention.
Figure 9A:
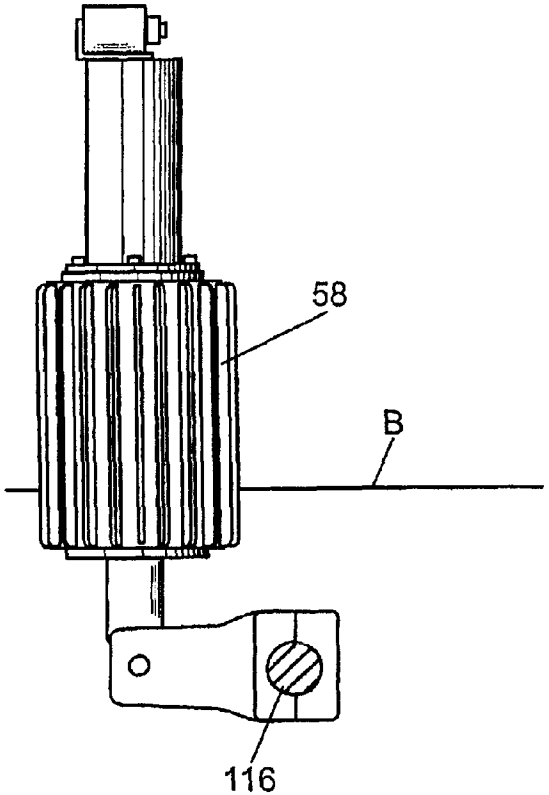

FIGS. 9(A) and 9(B) illustrate an example of a looper drive 58 having a linear drive according to an embodiment of the invention. As shown in this figure, movement of the looper drive 58 controls the rotation of a looper drive shaft 116 having a set of loopers 117. Thus, by controlling the looper drive 58, the processor 20 can control the timing and positioning of the loopers 117 relative to the rest of the tufting operation.

As mentioned above, each of the drives 52, 54, 56, 58, 60, and 62 may comprise one or more linear drives, such as one manufactured from California Linear Devices, Inc. As discussed above, the needle shifting drive 52 is coupled to the processor 20 and receives suitable control signals from the processor 20 for controlling the position of the shifting needle bar 76. Similarly, each of the other drives 54, 56, 58, 60, and 62 may receive control signals from the processor 20 for controlling the positioning, timing, and coordinating of the needles 50, knives 113, hooks 114, and loopers 117. Furthermore, the needle shifting drive 52 is associated with sensors 85, 86, and 87 for providing positional information to the processor. Similarly, each of the other drives 54, 56, 58, 60, and 62 may be associated with sensors for providing position feedback to the processor 20.

Tufting machines having linear drives, such as linear drive 52 having motor 72 offered by California Linear Devices, Inc., have a number of advantages over conventional tufting machines. The linear devices are programmable and avoid the need for cumbersome cams and other mechanical linkage. The linear devices offer better control over acceleration and deceleration, operate at high shock loads, in rugged, harsh environments, offer a value priced solution, and are green and clean. The linear drives operate without hydraulic lines and thus avoid the considerable amount of noise and the great deal of maintenance and supervision of the hydraulic lines and fluids. The linear drives can operate at high linear speeds, with precision accuracy, for a long life, and low maintenance. The linear drives avoid the need for oil lubrication, such as from an overhead bin, and therefore avoid problems with oil leaking onto the finished product.

The foregoing description of the preferred embodiments of the invention has been presented only for the purpose of illustration and description and is not intended to be exhaustive or to limit the invention to the precise forms disclosed. Many modifications and variations are possible in light of the above teaching.

For example, the invention has been described with reference to the needle shifting drive 52 having the needle bar 76. While not shown, the tufting machine 10 preferably has two shifting needle bars 76 and accordingly has two linear drives 52 for appropriately controlling each of the separate needle bars 76. The operation and design of the tufting machine having multiple needle bars 76 is apparent from the description of the linear drive 52 and needle bar 76.

The embodiments were chosen and described in order to explain the principles of the invention and their practical application so as to enable others skilled in the art to utilize the invention and various embodiments and with various modifications as are suited to the particular use contemplated.

I claim:

1. A tufting machine, comprising:

a needle push drive, a needle shifting drive, a bed rail drive, and (i) a looper drive, or (ii) a hook drive and a knife drive, wherein the needle shifting drive is a tubular linear drive and one of the needle push drive, the bed rail drive, and the looper drive or the hook drive and the knife drive is a tubular linear drive;

a processor that controls positioning of the tubular linear drives; and a timing unit that provides timing information to the processor used by the processor to synchronize the tubular linear drives.

2. The tufting machine of claim 1, wherein each of the needle push drive, the bed rail drive, and the looper drive or the hook drive and the knife drive is a tubular linear drive.

3. The tufting machine of claim 1, further comprising a position sensor that detects a position of each tubular linear drive and provides the processor with the position.

4. The tufting machine of claim 3, wherein the position sensor detects a home position of each tubular linear drive.

5. The tufting machine of claim 3, wherein the position sensor comprises a plurality of sensors that detect a permissible range of motion for each tubular linear drive.

6. The tufting machine of claim 1, wherein the timing unit comprises an encoder, resolver, or a stepping motor.

7. The tufting machine of claim 6, wherein the timing unit includes an encoder that is coupled to a main shaft or to part of a backing feed mechanism.

8. The tufting machine of claim 1, further comprising the looper drive.

9. The tufting machine of claim 1, further comprising the hook drive and the knife drive.

10. The tufting machine of claim 1, wherein each tubular linear drive is an electromagnetic drive.

* * * * *